US012194593B2

(12) United States Patent
Chen

(10) Patent No.: US 12,194,593 B2
(45) Date of Patent: Jan. 14, 2025

(54) METHOD FOR CONTROLLING REPAIRING APPARATUS AND REPAIRING APPARATUS

(71) Applicants: HKC CORPORATION LIMITED, Shenzhen (CN); CHONGQING HKC OPTOELECTRONICS TECHNOLOGY CO., LTD., Chongqing (CN)

(72) Inventor: Xiang Chen, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 1069 days.

(21) Appl. No.: 17/005,829

(22) Filed: Aug. 28, 2020

(65) Prior Publication Data

US 2020/0391345 A1 Dec. 17, 2020

Related U.S. Application Data

(63) Continuation of application No. PCT/CN2018/079021, filed on Mar. 14, 2018.

(30) Foreign Application Priority Data

Mar. 5, 2018 (CN) ..... 201810178010.2

(51) Int. Cl.

| | |
|---|---|
| ***B24B 49/00*** | (2012.01) |
| ***B24B 21/00*** | (2006.01) |
| ***B24B 21/04*** | (2006.01) |

(52) U.S. Cl.
CPC ..... *B24B 49/006* (2013.01); *B24B 21/004* (2013.01); *B24B 21/006* (2013.01); *B24B 21/04* (2013.01)

(58) Field of Classification Search
CPC ..... B24B 21/004; B24B 21/006; B24B 21/04; B24B 21/12; B24B 21/14; B24B 21/20;
(Continued)

(56) References Cited

FOREIGN PATENT DOCUMENTS

CN 101085508 A * 12/2007 ..... B24B 21/00
CN 101927444 A * 12/2010 ..... B24B 21/00
(Continued)

OTHER PUBLICATIONS

Machine translation of CN-101085508-A (Year: 2007).*
(Continued)

*Primary Examiner* — Robert F Neibaur
(74) *Attorney, Agent, or Firm* — Westbridge IP LLC

(57) ABSTRACT

The present application relates to a method for controlling a repairing apparatus and a repairing apparatus. The method for controlling the repairing apparatus includes: measuring, by a sensor, a height of a target object when a grinding part of the repairing apparatus completes positioning the target object; calculating an idle distance of a grinding belt on the grinding part in a predetermined process according to the height of the target object, in which, the predetermined process is the grinding part descending from the initial position to the highest position of the target object; and driving a motor to rotate back the grinding belt on the grinding part for the idle distance, and repairing the target object through the grinding belt on the grinding part.

10 Claims, 2 Drawing Sheets

(58) Field of Classification Search
CPC . B24B 2027/0015; B24B 49/10; B24B 49/12; B24B 49/16
USPC ..... 451/5, 6, 59, 168, 296, 297, 304, 310, 451/311, 499, 508, 513, 907
See application file for complete search history.

(56) References Cited

FOREIGN PATENT DOCUMENTS

| | | | | |
|---|---|---|---|---|
| CN | 102446788 | A | | 5/2012 |
| CN | 102666011 | A | | 9/2012 |
| CN | 204248570 | U | | 4/2015 |
| CN | 104959907 | A | | 10/2015 |
| CN | 105353535 | A | | 2/2016 |
| EP | 3159103 | A1 | * | 4/2017 |
| JP | 2008213049 | A | * | 9/2008 |
| JP | 2008290166 | A | | 12/2008 |
| WO | WO-2016008986 | A1 | * | 1/2016 ..... B24B 17/10 |

OTHER PUBLICATIONS

Machine translation of JP-2008213049-A (Year: 2008).*
Machine translation of CN-101927444-A (Year: 2010).*
Machine translation of WO-2016008986-A1 (Year: 2016).*
Machine translation of EP-3159103-A1 (Year: 2017).*
First Office Action in counterpart Chinese Application No. 201810178010.2, dated Apr. 28, 2019.
International Search Report in corresponding PCT Application No. PCT/CN2018/079021, dated Oct. 12, 2018.
Second Office Action in counterpart Chinese Application No. 201810178010.2, dated Oct. 23, 2019.
Third Office Action in counterpart Chinese Application No. 201810178010.2, dated Mar. 31, 2020.
Written Opinion in corresponding PCT Application No. PCT/CN2018/079021, dated Oct. 12, 2018.

* cited by examiner

METHOD FOR CONTROLLING REPAIRING APPARATUS AND REPAIRING APPARATUS

CROSS-REFERENCE TO RELATED APPLICATIONS

This application is a continuation application of International Patent Application No. PCT/CN2018/079021 with an international filing date of Mar. 14, 2018, designating the United States, which claims priority to Chinese Patent Application No. 201810178010.2 filed on Mar. 5, 2018. The contents of all of the aforementioned applications are incorporated herein by reference.

TECHNICAL FIELD

The present application relates to the technical field of apparatus control, and in particular relates to a method for controlling a repairing apparatus and a repairing apparatus.

BACKGROUND

The Liquid Crystal Display (LCD) screen has the advantages such as energy conservation and environment protection, light weight, etc., and has been widely used in the display area currently. At the same time, the LCD screen has a high contrast and a fast response speed, and has also been generally accepted by the market.

Various defects are inevitably introduced during the preparation of the liquid crystal display panel. In order to deal with the defects such as protrusions, the defects such as protrusions introduced during the preparation of the liquid crystal display panel may be ground and repaired by the repairing apparatus. However, the existing grinding and repairing methods may result in a waste of the grinding belt on the grinding part of a repairing machine.

SUMMARY

In view of this, embodiments of the present application provide a method for controlling a repairing apparatus and a repairing apparatus, in order to reduce the consumption of the grinding belt during the apparatus operation and reduce the production cost.

Embodiments of the present application provide a method for controlling a repairing apparatus. The method includes:

measuring, by a sensor, a height of a target object when a grinding part of the repairing apparatus completes a positioning of the target object;

calculating an idle distance of a grinding belt on the grinding part in a predetermined process according to the height of the target object, in which the predetermined process is that the grinding part descends from the initial position to the highest position of the target object; and driving a motor to rotate back the grinding belt on the grinding part for the idle distance, and repairing the target object through the grinding belt on the grinding part.

Embodiments of the present application further provide a repairing apparatus, which includes: a measuring module, an idle distance obtaining module, and a rotation repairing module. The measuring module is configured to measure, by a sensor, a height of a target object when a grinding part of the repairing apparatus completes positioning the target object. The idle distance obtaining module is configured to calculate the idle distance of a grinding belt on the grinding part in a predetermined process according to the height of the target object. The predetermined process is the grinding part descending from the initial position to the highest position of the target object. The rotation repairing module is configured to drive a motor so that the grinding belt on the grinding part is rotated through the idle distance, and repair the target object by the grinding belt on the grinding part.

Embodiments of the present application further provides a method for controlling a repairing apparatus, which includes:

measuring, by a sensor, a height of a target object when a grinding part of the repairing apparatus completes positioning the target object;

calculating the idle distance of a grinding belt on the grinding part in a predetermined process according to the height of the target object, in which the predetermined process is the grinding part descending from the initial position to the highest position of the target object;

driving a motor so that the grinding belt on the grinding part is rotated through the idle distance; and after driving the motor so that the grinding belt on the grinding part is rotated through the idle distance, driving the grinding part to descend from the initial position to the highest position of the target object, and grinding and repairing the target object by the grinding belt on the grinding part until the height of the target object reaches the target height.

The step of calculating the idle distance of the grinding belt on the grinding part in a predetermined process according to the height of the target object includes:

calculating the idle distance of the grinding belt on the grinding part in a predetermined process by the formula $$L = \frac{h_0 - h_x}{v_t} \times V;$$

in which, L represents the idle distance of the grinding belt, $h_0$ represents the height corresponding to the initial position of the grinding part, $h_x$ represents the height of the x-th target object, $v_t$ represents the descending speed of the grinding part, and V represents the linear rotational speed of the grinding belt.

Embodiments of the present application further provide a repairing apparatus, which includes: a memory, a processor, and a computer program stored in the memory and executable on the processor. The processor, when executing the computer program, implements steps in the embodiments of the method for controlling a repairing apparatus according to the present application.

Embodiments of the present application further provide a computer-readable storage medium in which a computer program is stored. The computer program, when being executed by one or more processors, implements steps in the embodiments of the method for controlling a repairing apparatus according to the present application.

Embodiments of the present application further provide a computer program product, which includes a computer program. The computer program, when being executed by one or more processors, implements steps in the embodiments of the method for controlling a repairing apparatus according to the present application.

According to embodiments of the present application, the height of the target object is measured by a sensor when the grinding part of the repairing apparatus positions the target object. The idle distance of a grinding belt on the grinding part is calculated in the process that the grinding part descends from the initial position to the highest position of the target object based on the height of the target object. A motor is driven so that the grinding belt on the grinding part is rotated through the idle distance, and the target object is repaired by the grinding belt on the grinding part. As the repairing apparatus will retreat the idle part of the grinding belt back during the operation, the waste of the idle part of the grinding belt is avoided, the consumption of the grinding belt during the operation of the apparatus is reduced, and the production cost is reduced.

BRIEF DESCRIPTION OF THE DRAWINGS

For the purpose of describing the technical solutions in the embodiments of the present application more clearly, the accompanying drawings required for describing the embodiments or the prior techniques will be briefly introduced below. It is apparent that the accompanying drawings in the following description are merely some embodiments of the present application. Those skilled in the art may obtain other drawings according to the accompanying drawings without creative efforts.

DESCRIPTION OF THE EMBODIMENTS

In the following description, for the purpose of explanation rather than limitation, specific details are set forth such as particular system architectures, techniques, etc. in order to provide a thorough understanding of the embodiments of the present application. However, it will be apparent to those skilled in the art that the present application may be implemented in other embodiments that are not particularly subject to these specific details. In other instances, detailed descriptions of well-known systems, devices, circuits, and methods are omitted so as not to obscure the description of the present application with unnecessary detail.

It will be understood that the term "comprising/including", when used in this specification and the appended claims, represents the presence of stated features, integers, steps, operations, elements, and/or components, but does not preclude the presence or addition of one or more other features, integers, steps, operations, elements, components, and/or groups thereof.

It is also to be understood that the terminology used herein in the specification of the present application is for the purpose of merely describing particular embodiments and is not intended to limit the present application. As used in the specification of the present application and the appended claims, the singular forms such as "a", "an" and "the" are intended to include the plural forms unless the context clearly represents otherwise.

It is further to be understood that the term "and/or" as used in the specification of the present application and appended claims refers to any and all possible combinations of one or more of the associated listed items, and includes these combinations.

As used in this specification and the appended claims, the term "if" may be interpreted as "when" or "once" or "in response to determining" or "in response to detecting" from the context. Similarly, the phrase "if determining" or "if detecting [the described condition or event]" may be interpreted as meaning "once determining" or "in response to determining" or "once detecting [the described condition or event]" or "in response to detecting [the described condition or event]" from the context.

For the purpose of describing the technical solutions described in the present application, the description will refer to the specific embodiments below.

Figure 1:
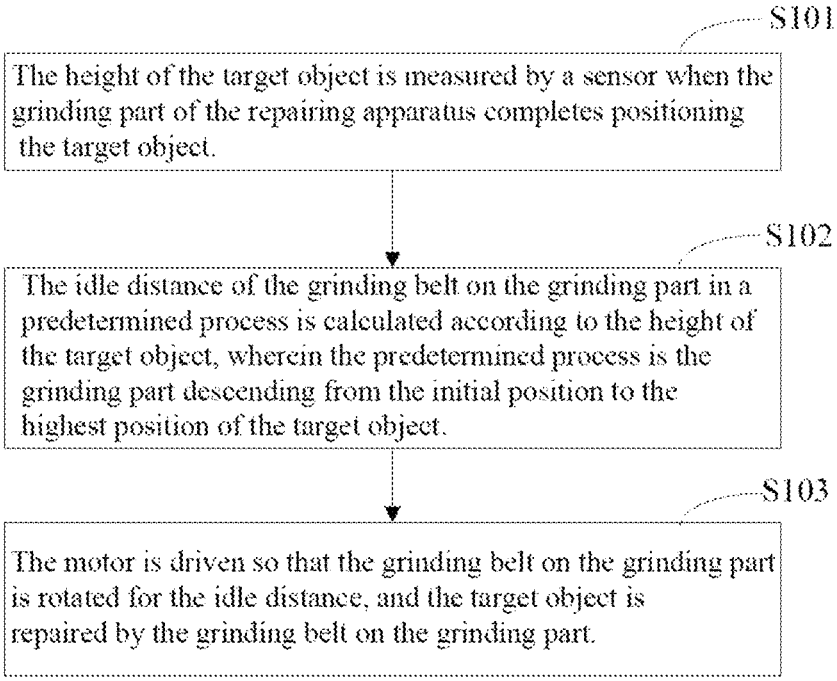
FIG. 1 is a schematic view of implementing procedure of a method for controlling a repairing apparatus provided by an embodiment of the present application.

FIG. 1 is a schematic view of implementing processes of a method for controlling a repairing apparatus provided by some embodiments of the present application. As shown in the figure, the method may include the following steps:

Step S101: the height of the target object is measured by a sensor when the grinding part of the repairing apparatus completes positioning the target object.

In the embodiments of the present application, the target object may be a defect to be repaired, such as a protrusion higher than the liquid crystal panel. Various defects may be introduced during the preparation of the liquid crystal display panel. The defects such as protrusions may be repaired by the repairing apparatus. In the process of repairing, since there may be more than one target object to be repaired on the sample to be repaired, in the process of repairing each target object, the target object to be repaired needs to be positioned first. In the process of repairing, since the target object is repaired by the grinding part of the repairing apparatus, the grinding part of the repairing apparatus needs to position the target object. After the grinding part of the repairing apparatus positions the target object, the height of the target object may be measured by the sensor mounted on the repairing apparatus first. The height of the target object may be based on the height of a plane on which a liquid crystal panel is located where the target object is located.

Step S102: an idle distance of the grinding belt on the grinding part in a predetermined process is calculated according to the height of the target object, in which the predetermined process is the grinding part descending from the initial position to the highest position of the target object.

In the embodiments of the present application, after positioning the target object, the grinding part will be located in some position at a distance above the target object. The position when the grinding part positions the target object may be taken as the initial position. The grinding part descends from the initial position to the highest position of the target object so as to grind and repair the target object by the grinding belt on the grinding part. In the process that the grinding part descends from the initial position to the highest position of the target object, the grinding belt on the grinding part is always idle. The target object may be ground and repaired by the grinding belt on the grinding part only after the grinding belt on the grinding part touches the target object. That is to say, in the process that the grinding part descends, the idle part of the grinding belt does not grind, and this part is a wasted part. Therefore, the idle distance of the grinding belt on the grinding part in the process that the grinding part descends from the initial position to the highest position of the target object may be calculated.

As yet another embodiment of the present application, calculating the idle distance of the grinding belt on the grinding part in a predetermined process according to the height of the target object includes:

calculating the idle distance of the grinding belt on the grinding part in a predetermined process by the formula $$L = \frac{h_0 - h_x}{v_t} \times V;$$

in which, L represents the idle distance of the grinding belt, $h_0$ represents the height corresponding to the initial position of the grinding part, $h_x$ represents the height of the x-th target object, $v_t$ represents the descending speed of the grinding part, and V represents the linear rotational speed of the grinding belt.

Figure 2:
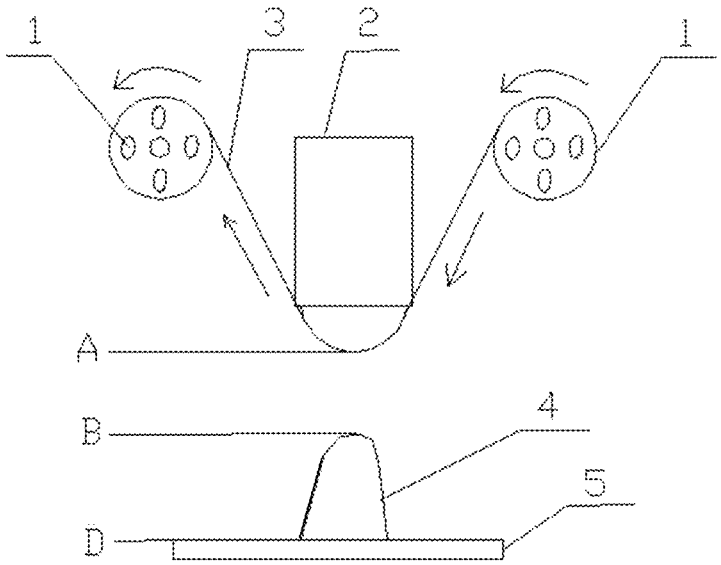
FIG. 2 is a schematic view of calculating an idle distance of the grinding belt provided by an embodiment of the present application.

In the embodiments of the present application, how to calculate the idle distance of the grinding belt on the grinding part in the process that the grinding part descends from the initial position to the highest position of the target object will be described with reference to FIG. 2. As shown in FIG. 2, after the grinding part 2 positions the target object 4, the height (vertical distance of BD, hereinafter abbreviated as BD) of the target object may be measured. A motor is driven, and the turntable 1 where the grinding belt 3 is located is rotated so that the grinding belt 3 may pass through the lowest end of the grinding part 2.

The vertical distance (abbreviated as AB) between the initial position (A) of the grinding part 2 and the highest position (B) of the target object 4 may be obtained first. Then the idle time of the grinding belt 3 is calculated according to the vertical distance (AB) between the initial position of the grinding part and the highest position of the target object and the descending speed of the grinding part 2. Finally, the idle distance of the grinding belt 3 may be obtained according to the idle time of the grinding belt 3 and the linear rotational speed of the grinding belt 3. The linear rotational speed of the grinding belt 3 is the linear speed at which the grinding belt passes through the lowest end of the grinding part.

The initial position A of the grinding part 2 may be preset in the repairing apparatus, and the grinding part 2 positions the initial position A according to the preset initial position. In this way, the vertical distance between the ADs is fixed. Of course, in practical applications, the height corresponding to the initial position A of the grinding part 2 (hereinafter abbreviated as AD) may also be measured by a sensor. The height (AD) corresponding to the initial position A of the grinding part 2 is the height of the lowest point A of the grinding part with respect to the liquid crystal panel 5 when the grinding part 2 is located in the initial position A. The height (AD) corresponding to the initial position A of the grinding part 2 and the height (BD) of the target object 4 need to be based on the same reference object, that is, selecting the same plane as a reference. For example, both of them are based on the upper plane (the plane where D is located) of the liquid crystal panel 5. In practical applications, other planes may also be selected as a reference. Examples will not be given one by one.

The descending speed of the grinding part may be set on the repairing apparatus, and may be obtained according to the set descending speed of the grinding part or obtained by the measurement of a speed sensor. Similarly, the linear rotational speed of the grinding belt may also be preset on the repairing apparatus, and may be obtained according to the set linear rotational speed of the grinding part or obtained by the speed sensor.

Step S103: the motor is driven so that the grinding belt on the grinding part is rotated through the idle distance, and the target object is repaired by the grinding belt on the grinding part.

In the embodiments of the present application, the grinding belt does not perform grinding operation on the target object but idles in the process that the grinding part descends from the initial position to the highest point of the target object. Therefore, the idle part of the grinding belt may be used actually. In order to avoid wastage, after obtaining the idle distance by calculation, the grinding belt on the grinding part may be retreated back for the idle distance. In this way, the idle grinding belt may be used again during the repairing operation of the target object. The turntable 1 where the grinding belt is located may be driven by the motor to rotate in reverse. The grinding belt on the grinding part is rotated through the idle distance. After rotation for the idle distance, the target object may be repaired by the grinding belt on the grinding part.

As yet another embodiment of the present application, the step of driving the motor so that the grinding belt on the grinding part is rotated through the idle distance may be provided prior to the step of driving the grinding part to descend from the initial position to the highest position of the target object.

In the embodiments of the present application, if the descending speed of the grinding mechanism and the rotational linear angle of the grinding belt can be preset, it represents that the descending speed of the grinding mechanism and the rotational linear angle of the grinding belt are fixed values. Moreover, both the height corresponding to the initial position of the grinding part and the highest position of the target object may be obtained in a state that the grinding part is located in the initial position. Therefore, after the grinding mechanism positions the target object, the idle distance may be obtained by calculation, and the grinding belt may be rotated in the initial position for the idle distance (the rotated grinding belt is the grinding belt consumed in the process of repairing the previous target object). Then in the process that the grinding mechanism descends, the part of the grinding belt consumed in the process of repairing the previous target object idles. When the grinding mechanism reaches the highest position of the target object, the grinding belt just idles to the critical position between the used grinding belt and the unused grinding belt in the process of repairing the previous target object so that the current target object may be ground and repaired by the grinding belt on the grinding mechanism.

As yet another embodiment of the present application, the step of driving the motor so that the grinding belt on the grinding part is rotated through the idle distance may be provided subsequent to the step of driving the grinding part to descend from the initial position to the highest position of the target object.

If it is set that the grinding mechanism does not perform the rotating operation in the initial position, the grinding belt will idle in the descending process. The idle part of the grinding belt is used when the grinding and repairing operation is not performed. The descending speed of the grinding mechanism and the linear rotational speed of the grinding belt may be detected in the process that the grinding mechanism descends from the initial position to the highest point of the target object. When or after the grinding mechanism descends from the initial position to the highest point of the target object, the idle distance of the grinding belt on the grinding part is obtained by calculation according to the detected descending speed of the grinding mechanism, the linear rotational speed of the grinding belt, the obtained initial position of the grinding mechanism and the height of the target object. After the grinding mechanism descends from the initial position to the highest point of the target object, the idle and unused part of the grinding belt is further retreated for the idle distance so that the idle and unused grinding belt is just completely retreated.

In practical applications, the step of driving the motor so that the grinding belt on the grinding part is rotated through the idle distance may be provided prior to or subsequent to the step of driving the grinding part to descend from the initial position to the highest position of the target object. That is to say, it is possible to select whether to perform the rotating operation when the grinding part is in the initial position or perform the rotating operation when the grinding part is in the position at the highest point of the target object according to the specific situation. Of course, it is also possible to perform the rotating operation when setting at any position in the process that the grinding mechanism descends, which is within the protection scope of the present application.

In a specific application, it is also possible to set a target height (the vertical distance of the CD) after the target object is ground and repaired, and then, when the target object is repaired by the grinding belt on the grinding part, the height of the target object needs to be ground and repaired to the target height.

After grinding and repairing the target object by the grinding belt on the grinding part until the height of the target object reaches the target height, it further includes: driving the grinding part to ascend to the initial position and positioning the next target object so as to grind and repair the next target object.

In the embodiments of the present application, since a plurality of target objects may be contained on the sample to be repaired, it is required that after the current target object is ground and repaired, the grinding part is driven to ascend to the initial position and the next target object is positioned. The method of the embodiments of the present application is repeated for the next target object to be ground and repaired.

According to the embodiments of the present application, the saving amount of the grinding belt whenever repairing operation is performed on a target object after the rotating operation is added may be calculated, i.e., the idle distance of the grinding belt. It is first assumed that the descending speed of the grinding structure is 0.004 mm/s, the linear rotational speed of the grinding belt is 5 mm/s, the initial position of the grinding mechanism is 0.011 mm, and the height of the target object is 0.006 mm. The idle distance of the grinding belt which is first obtained by calculation according to the above parameter is (0.011−0.006)/0.004*5=6.25 mm.

In order to compare the saving amount of the grinding belt, we continue to calculate the actual consumption of the grinding belt during the grinding and repairing operation whenever a target object is ground. The height of the target object is 0.006 mm, the target height is 0.001 mm, the target object is ground to the target height, and the length of the actually consumed grinding belt is 11.25 mm. However, if the rotating operation is not added, 17.5 mm needs to be consumed whenever a target object is repaired (the actual grinding consumption plus idle part).

It is assumed that a total length of a roll of the grinding belt is 50 m, without adding the rotating operation, the number of the target objects ground by a roll of the grinding belt is 50 m/17.5 mm=2857. However, in order to grind and repair such 2857 target objects, the idle length is 17.86 m, and the length used for actually grinding is 32.14 m. After the rotating operation is added, the number of the target objects ground by a roll of the grinding belt is (50−6.25)/11.25=4443, and the number of the ground target objects is increased by 4443−2857=1586.

In the embodiment of the present application, the idle part of the grinding belt is rotated by adding the rotating operation so as to save the grinding belt and reduce the production cost.

It should be understood that the size of the serial number of each step in the above embodiments does not mean the sequence of execution. The sequence of execution of each process should be determined by its function and inherent logic, and should not constitute any limitation on the implementation process of the embodiments of the present application.

Figure 3:
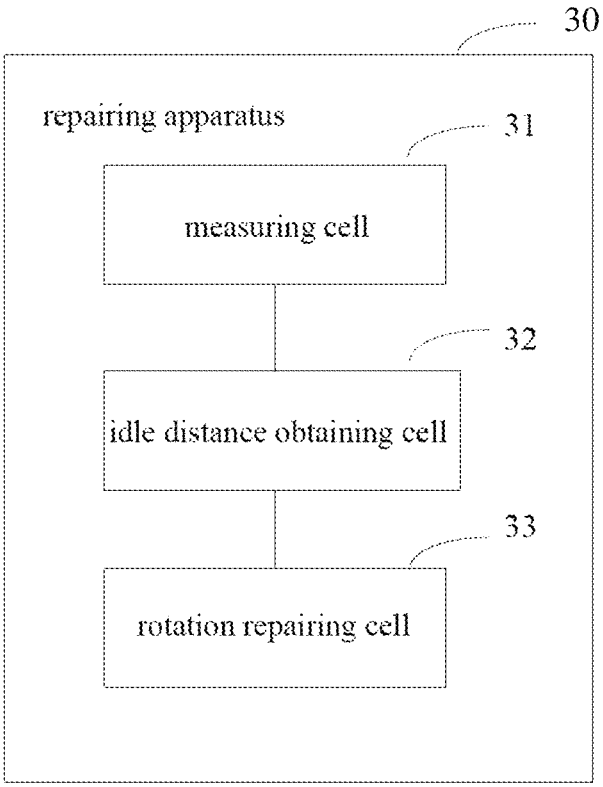
FIG. 3 is a schematic block view of a repairing apparatus provided by an embodiment of the present application.

FIG. 3 is a schematic block view of a repairing apparatus provided by some embodiments of the present application. For ease of description, only parts related to the embodiments of the present application are shown.

The repairing apparatus 30 may be a software unit, a hardware unit or a unit of a combination of hardware and software, and may also be integrated into an existing repairing apparatus as an independent component.

The repairing apparatus 30 includes: a measuring module 31, an idle distance obtaining module 32, and a rotation repairing module 33. The measuring module 31 is configured to measure, through a sensor, the height of the target object when the grinding part of the repairing apparatus completes positioning the target object. The idle distance obtaining module 32 is configured to calculate the idle distance of a grinding belt on the grinding part in a predetermined process according to the height of the target object, in which the predetermined process is the grinding part descending from the initial position to the highest position of the target object. The rotation repairing module 33 is configured to drive a motor so that the grinding belt on the grinding part is rotated through the idle distance, and repair the target object by the grinding belt on the grinding part.

Optionally, the idle distance obtaining module 32 is configured to: calculate the idle distance of the grinding belt on the grinding part in a predetermined process by the formula $$L = \frac{h_0 - h_x}{v_t} \times V;$$

in which, L represents the idle distance of the grinding belt, $h_0$ represents the height corresponding to the initial position of the grinding part, $h_x$ represents the height of the x-th target object, $v_t$ represents the descending speed of the grinding part at the current time, and V represents the linear rotational speed of the grinding belt.

Optionally, the repairing apparatus 30 includes: a setting module configured to preset the descending speed of the grinding part and the linear rotational speed of the grinding belt before calculating the idle distance of the grinding belt on the grinding part in a predetermined process according to the height of the target object.

Optionally, the repairing apparatus 30 further includes: a first obtaining module, and a second obtaining module. The first obtaining module is configured to obtain, by the measurement of a first sensor, the descending speed of the grinding part before calculating the idle distance of the grinding belt on the grinding part in a predetermined process according to the height of the target object. The second obtaining module is configured to obtain, by the measurement of a second sensor, the linear rotational speed of the grinding belt before calculating the idle distance of the grinding belt on the grinding part in a predetermined process according to the height of the target object.

Optionally, the repairing apparatus 30 further includes: a driving descending module configured to drive the grinding part to descend from the initial position to the highest position of the target object. The rotation repairing module 33 is configured to grind and repair the target object by the grinding belt on the grinding part until the height of the target object reaches the target height.

Optionally, the repairing apparatus 30 further includes a driving ascending module. The driving ascending module is configured to drive the grinding part to ascend to the initial position and position the next target object so as to grind and repair the next target object.

Optionally, the repairing apparatus 30 further includes a driving descending module. The driving descending module is configured to drive the grinding part to descend from the initial position to the highest position of the target object after driving the motor so that the grinding belt on the grinding part is rotated through the idle distance. The rotation repairing module is configured to grind and repair the target object by the grinding belt on the grinding part until the height of the target object reaches the target height.

Optionally, the repairing apparatus 30 further includes an initial position recovering module. The initial position recovering module is configured to drive the grinding part to ascend to the initial position and position the next target object so as to grind and repair the next target object.

Optionally, the height corresponding to the initial position of the grinding part and the height of the target object are based on the same reference object.

Those skilled in the art may clearly understand that, for the convenience and simplicity of description, only the division of the above function modules is used as an example. In practical applications, the above function allocation may be accomplished by different function modules as needed. That is to say, the internal structure of the repairing apparatus is divided into different function modules to accomplish all or part of the functions described above. Each of the function modules in some embodiments may be integrated in one processing module, or each of the modules may exist in a single physical manner, or two or more modules may be integrated in one module. The above integrated module may be implemented in the form of hardware, or may be implemented in the form of a software function module. In addition, the specific names of the various function modules are merely for the convenience of distinguishing each other and are not intended to limit the protection scope of the present application. For the specific working process of the module in the foregoing device, reference may be made to the corresponding process in the foregoing method embodiment, which will not be described herein again.

Figure 4:
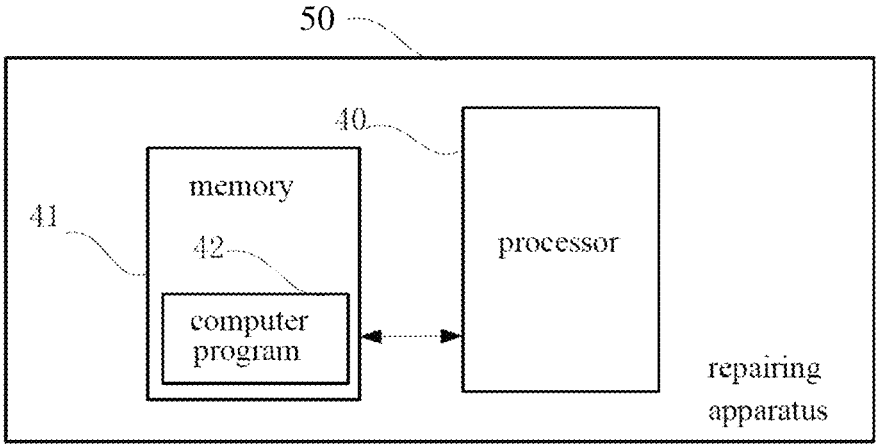
FIG. 4 is a schematic block view of a repairing apparatus provided by another embodiment of the present application.

FIG. 4 is a schematic block view of a repairing apparatus provided by other embodiments of the present application. As shown in FIG. 4, the repairing apparatus 50 of embodiments includes one or more processors 40, a memory 41, and a computer program 42 stored in the memory 41 and executable on the processor 40. The processor 40, when executing the computer program 42, implements steps in the embodiments of the method for controlling a repairing apparatus described above, such as steps S101 to S103 shown in FIG. 1. Alternatively, the processor 40, when executing the computer program 42, implements the functions of each module/unit in the embodiments of the repairing apparatus described above, such as the functions of the modules 31 to 33 shown in FIG. 3.

Exemplarily, the computer program 42 may be divided into one or more modules/units, which are stored in the memory 41 and executed by the processor 40 to complete the present application. The one or more modules/units may be a series of computer program instruction segments capable of completing a particular function, and the instruction segments are used to describe the executing process of the computer program 42 in the repairing apparatus 50. For example, the computer program 42 may be divided into a measuring cell, an idle distance obtaining cell, and a rotation repairing cell.

The measuring module is configured to measure, by a sensor, the height of the target object when the grinding part of the repairing apparatus completes positioning the target object;

the idle distance obtaining module is configured to calculate the idle distance of a grinding belt on the grinding part in the predetermined process according to the height of the target object, in which the predetermined process is the grinding part descending from the initial position to the highest position of the target object; and the rotation repairing module is configured to drive a motor so that the grinding belt on the grinding part is rotated through the idle distance, and repair the target object by the grinding belt on the grinding part.

For other modules or units, reference may be made to the description in the embodiments shown in FIG. 3, which will not be described herein again.

The repairing apparatus includes but is not limited to the processor 40 and the memory 41. It may be understood by those skilled in the art that FIG. 4 is merely an example of the repairing apparatus 50 and does not constitute a limitation on the repairing apparatus 50, and may include more or fewer components than shown, or a combination of some components, or different components. For example, the repairing apparatus may further include an input device, an output device, a network access device, a bus, etc.

The processor 40 may be a Central Processing Unit (CPU), a general purpose processor, a Digital Signal Processor (DSP), an Application Specific Integrated Circuit (ASIC), a Field-Programmable Gate Array (FPGA), a programmable logic device, a discrete gate or a transistor logic device, a discrete hardware component, etc. The general purpose processor may be a microprocessor or the processor may also be any conventional processor, etc.

The memory 41 may be an internal storage unit of the repairing apparatus 50, such as a hard disk or a memory of the repairing apparatus 50. The memory 41 may also be an external storage device of the repairing apparatus 50, such as a plug-in hard disk, a Smart Media Card (SMC), a Secure Digital (SD) card, a flash card, etc. provided on the repairing apparatus 50. Further, the memory 41 may further include both an internal storage unit and an external storage device of the repairing apparatus 50. The memory 41 is used to store the computer program and other programs and data required by the repairing apparatus. The memory 41 may also be used to temporarily store data that has been or will be output.

In the above embodiments, the description of different embodiments has different focus, and the parts that are not described or recorded in some embodiments may refer to the related descriptions in other embodiments.

It may be appreciated by those skilled in the art that the units and algorithm steps of each example described in combination with the embodiments disclosed herein are capable of being implemented by electronic hardware or a combination of computer software and electronic hardware. Whether these functions are implemented by hardware or software depends on the specific application and design constraints of the technical solutions. Those skilled in the art may use different methods to implement the described functions for each particular application, but such implementation should not be considered to go beyond the scope of the present application.

In the embodiments provided by the present application, it should be understood that the disclosed repairing apparatus and method may be implemented in other manners. For example, the repairing apparatus embodiments described above is merely exemplary. For example, the division of the modules or units is merely logical function division, and there may be other division manners in actual implementation. For example, multiple units or components may be combined or integrated into another system, or some of the features may be ignored or not implemented. In addition, the mutual coupling or direct coupling or communication connection shown or discussed may be indirect coupling or communication connection through some interfaces, devices or units, and may be in electrical, mechanical or other forms.

The units described as separate components may or may not be physically separated. The components displayed as units may or may not be physical units. That is to say, the components may be located in one place or may also be distributed to multiple network units. Some or all of the units may be selected according to actual needs to achieve the objectives of the solution in this embodiment.

In addition, each of the function units in different embodiments of the present application may be integrated in one processing unit, or each of the units may exist in a single physical manner, or two or more units may be integrated in one unit. The above integrated modules may be implemented in the form of hardware or may be implemented in the form of a software function unit.

If implemented in the form of a software function unit and when sold or used as an independent product, the integrated modules/units may be stored in a computer-readable storage medium. Based on this understanding, all or a part of the processes of the present application for implementing the above exemplary method may also be implemented by instructing relevant hardware through a computer program. The computer program may be stored in a computer-readable storage medium. The computer program, when being executed by the processor, may implement steps in each of the method embodiments described above. Herein, the computer program includes a computer program code, which may be in the form of a source code, in the form of an object code, in the form of an executable file or in some intermediate form, etc. The computer-readable medium may include any entity or device capable of carrying the computer program code, a recording medium, a USB flash drive, a removable disk, a magnetic disk, an optical disk, a computer memory, a Read-Only Memory (ROM), a Random Access Memory (RAM), electrical carrier signals, telecommunications signals, a software distribution medium, etc. It should be noted that the content contained in the computer-readable medium may be appropriately increased or decreased according to the requirements of legislation and patent practice in the jurisdiction. For example, in some jurisdictions, according to legislation and patent practice, a computer-readable medium excludes electric carrier signals and telecommunication signals.

The foregoing embodiments are merely intended for describing the technical solutions of the present application rather than limiting the present application. Although the present application is described in detail with reference to the foregoing embodiments, it should be understood by those skilled in the art that the technical solutions recorded in each of the foregoing embodiments may still be modified or some of the technical features may be replaced equivalently. These modifications or replacements do not make the essence of the corresponding technical solutions depart from the spirit and scope of the technical solutions of each of the embodiments of the present application, and should be included within the protection scope of the present application.

What is claimed is:

1. A method for controlling a repairing apparatus, comprising the following operations: measuring, by a sensor, a height of a target object when a grinding part of the repairing apparatus completes a positioning of the target object; calculating an idle distance of a grinding belt on the grinding part in a predetermined process according to the height of the target object, the predetermined process being that the grinding part descends from an initial position to the highest position of the target object; and driving a motor to rotate back the grinding belt on the grinding part for the idle distance, and repairing the target object through the grinding belt on the grinding part; wherein the operation of calculating an idle distance of the grinding belt on the grinding part in a predetermined process according to the height of the target object comprises: calculating the idle distance of the grinding belt on the grinding part in the predetermined formula $$L=((h0-hx)/vt)*V,$$

wherein, L represents the idle distance of the grinding belt, $h^0$ represents a height corresponding to the initial position of the grinding part, hx represents a height of the x-th target object, vt represents a descending speed of the grinding part, and V represents a linear rotational speed of the grinding belt.

2. The method of claim 1, wherein before the operation of calculating the idle distance of the grinding belt on the grinding part in the predetermined process according to the height of the target object, the method further comprises: presetting the descending speed of the grinding part and the linear rotational speed of the grinding belt.

3. The method of claim 1, wherein before the operation of calculating the idle distance of the grinding belt on the grinding part in the predetermined process according to the height of the target object, the method further comprises: obtaining, by a measurement of a first sensor, the descending speed of the grinding part; and obtaining, by the measurement of a second sensor, the linear rotational speed of the grinding belt.

4. The method of claim 1, wherein before the operation of driving the motor to rotate back the grinding belt on the grinding part for the idle distance, the method further comprises: driving the grinding part to descend from the initial position to the highest position of the target object; and wherein repairing the target object through the grinding belt on the grinding part comprises: grinding and repairing the target object through the grinding belt on the grinding part until the height of the target object reaches a target height.

5. The method of claim 4, wherein after the operation of grinding and repairing the target object by the grinding belt on the grinding part until the height of the target object reaches the target height, the method further comprises:

driving the grinding part to ascend to the initial position and positioning a next target object so as to grind and repair the next target object.

6. The method of claim 1, wherein, after the operation of driving the motor to rotate back the grinding belt on the grinding part for the idle distance, the method further comprises: driving the grinding part to descend from the initial position to the highest position of the target object; and wherein repairing the target object through the grinding belt on the grinding part comprises: grinding and repairing the target object through the grinding belt on the grinding part until the height of the target object reaches a target height.

7. The method of claim 6, wherein, after the operation of grinding and repairing the target object by the grinding belt on the grinding part until the height of the target object reaches the target height, the method further comprises: driving the grinding part to ascend to the initial position and positioning a next target object so as to grind and repair the next target object.

8. The method of claim 1, wherein, the height corresponding to the initial position of the grinding part and the height of the target object are determined based on a same reference object.

9. The method of claim 8, wherein, the reference object is a plane on the target object on which a liquid crystal panel is located where the target object is located.

10. A method for controlling a repairing apparatus, comprising the following operations:

measuring, by a sensor, a height of a target object when a grinding part of the repairing apparatus completes a positioning of the target object;

calculating an idle distance of a grinding belt on the grinding part in a predetermined process according to the height of the target object, wherein the predetermined process is the grinding part descending from an initial position to the highest position of the target object;

driving a motor to rotate back the grinding belt on the grinding part for the idle distance; and driving the grinding part to descend from the initial position to the highest position of the target object, and grinding and repairing the target object through the grinding belt on the grinding part until the height of the target object reaches the target height, after driving the motor to rotate back the grinding belt on the grinding part for the idle distance;

wherein the operation of calculating the idle distance of the grinding belt on the grinding part in the predetermined process according to the height of the target object comprises:

calculating the idle distance of the grinding belt on the grinding part in the predetermined process by the formula $$L=((h0-hx)/vt)*V$$

wherein, L represents the idle distance of the grinding belt, ho represents a height corresponding to the initial position of the grinding part, hx represents a height of the x-th target object, vt represents a descending speed of the grinding part, and V represents a linear rotational speed of the grinding belt.

* * * * *